United States Patent [19]

Dagostine

[11] Patent Number: 4,834,240

[45] Date of Patent: May 30, 1989

[54] CARTON HAVING PREMIUM CARD FORMED INTEGRALLY THEREWITH

[75] Inventor: Leslie J. Dagostine, Dollard Des Orm., Canada

[73] Assignee: Paperboard Industries Corporation, Toronto, Canada

[21] Appl. No.: 251,078

[22] Filed: Sep. 28, 1988

Related U.S. Application Data

[63] Continuation of Ser. No. 106,258, Oct. 9, 1987, abandoned..

[51] Int. Cl.[4] ..... B65D 5/42

[52] U.S. Cl. ..... 206/459; 206/831

[58] Field of Search ..... 40/312; 229/118; 206/459, 831

[56] References Cited

U.S. PATENT DOCUMENTS

| | | | |
|---|---|---|---|
| 3,147,856 | 9/1964 | Lightner et al. | 206/831 |
| 3,183,614 | 5/1965 | Loderhose | 206/831 |
| 3,219,253 | 11/1965 | Davis | 206/831 |
| 3,389,850 | 6/1968 | Rockefeller | 206/831 |
| 3,625,412 | 12/1971 | Rosenburg, Jr. | 206/831 |
| 4,103,820 | 8/1978 | Mathison | 206/831 |
| 4,108,350 | 8/1978 | Forbes, Jr. | 206/831 |
| 4,453,664 | 6/1984 | Oliff | 40/312 |

FOREIGN PATENT DOCUMENTS

| | | | |
|---|---|---|---|
| 1101199 | 10/1955 | France | 40/312 |

*Primary Examiner*—Stephen Marcus
*Assistant Examiner*—Gary E. Elkins
*Attorney, Agent, or Firm*—Fetherstonhaugh & Co.

[57] ABSTRACT

In a carton a premium card is formed integrally with a glue flap of the carton along a weakened tear line so that it extends within the container space of the carbon in a face-to-face relationship with respect to an adjacent side wall. The premium card has a glue tab connected thereto at a point remote from the glue flap. The glue tab is adhesively secured to the inner face of the adjacent side wall of the carton to retain the card in an intimate face-to-face relationship with respect to the adjacent side wall. The card is detachable by tearing along weakened tear lines which connect it to the glue tab and the glue flap so as to be removable.

3 Claims, 3 Drawing Sheets

CARTON HAVING PREMIUM CARD FORMED INTEGRALLY THEREWITH

Figure 1:
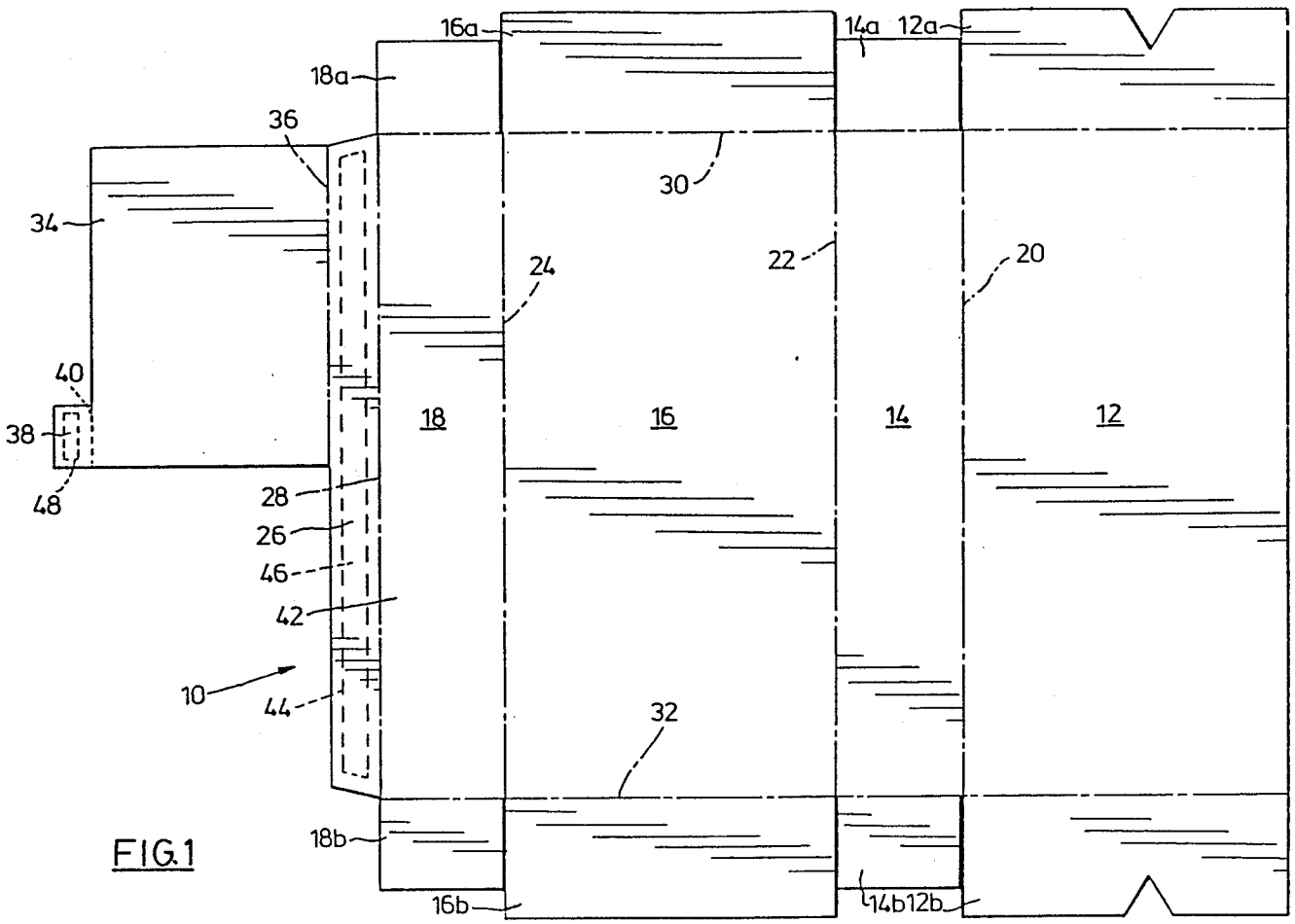

This application is a continuation of application Ser. No. 106,258, filed Oct. 9, 1987, now abandoned.

This invention relates to cartons and premium cards of the type frequently distributed in cartons.

Prior Art

Premium cards such as baseball cards, hockey cards or the like which are printed with a picture of a sports celebrity and which provide statistical information relating to the celebrity are frequently packaged along with consumer goods in cartons in sales promotion programs. Generally, the practice is to place the card into the carton simultaneously with the loading of the carton with products. This requires a separate stuffing or loading procedure. In addition, it is customary to print the cards in a separate printing operation from that used to print the advertising material which appears on the front face of the carton. Thus, it is normal practice to manufacture a carton and to manufacture a card and then to insert the card within the carton during the carton loading operation.

The present invention provides a simple and inexpensive carton construction which incorporates as an integral component, a detachable card. Because the card is initially connected to the carton blank, it is possible to print the distinctive features which are to be applied to the card during the same printing operation as that used in order to print the advertising material on the front face of the carton.

In addition, because the card is formed from the same blank a that used to produce the carton and it is automatically positioned within the interior of the carton when the carton is assembled, it is not necessary to use an addition stuffing or loading mechanism or production step in order to locate the card within the carton.

In addition, because the premium card is releaseably secured to the walls of the carton, it does not form an obstruction which will interfere with the loading of the carton. In addition, because the card is prepositioned within the carton before loading, the card itself is not damaged by the act of stuffing the card into the carton.

Summary of Invention

It is an object of the present invention to provide a simple and inexpensive carton assembly which incorporates a premium card releaseably secured in the load storage compartment of the carton.

According to one aspect of the present invention, there is provided in a carton of the type having a plurality of side wall panels hingedly connected to a first of said panel and adhesively connected in a face-to-face relationship with respect to a marginal edge portion of the inner face of a second of said panel to form a tubular sleeve, the improvement of a premium card formed integrally with said glue flap and connected thereto along a first weakened tear line, said card having a glue tab connected thereto at a point remote from the first weakened tear line along a second weakened tear line, said glue tab being adhesively secured to the inner face of said second panel to retain the card in the carton in an intimate face-to-face relationship with said second panel, said card being detachable by tearing along the weakened tear lines to be removable from the carton.

Figure 2:
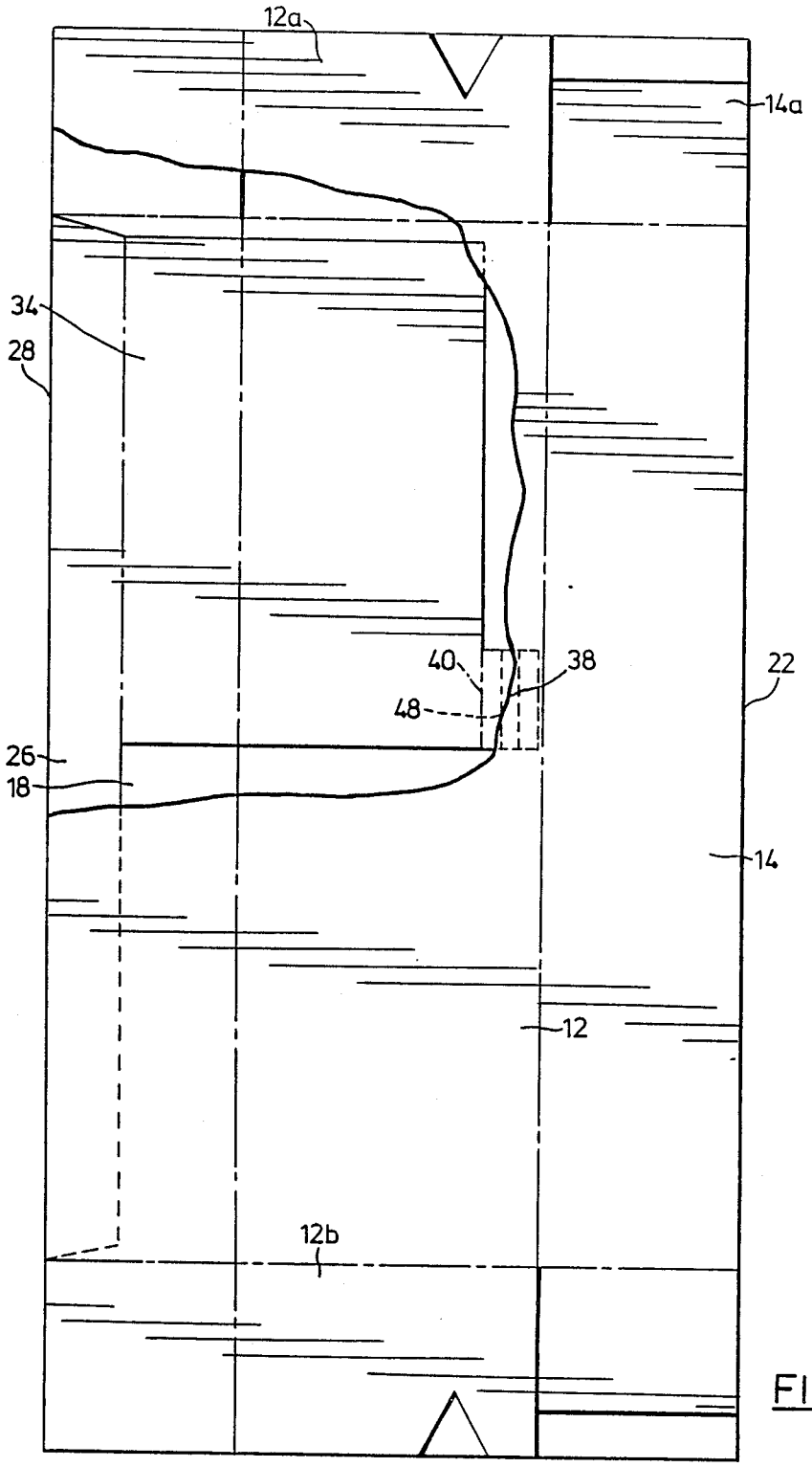
Figure 3:
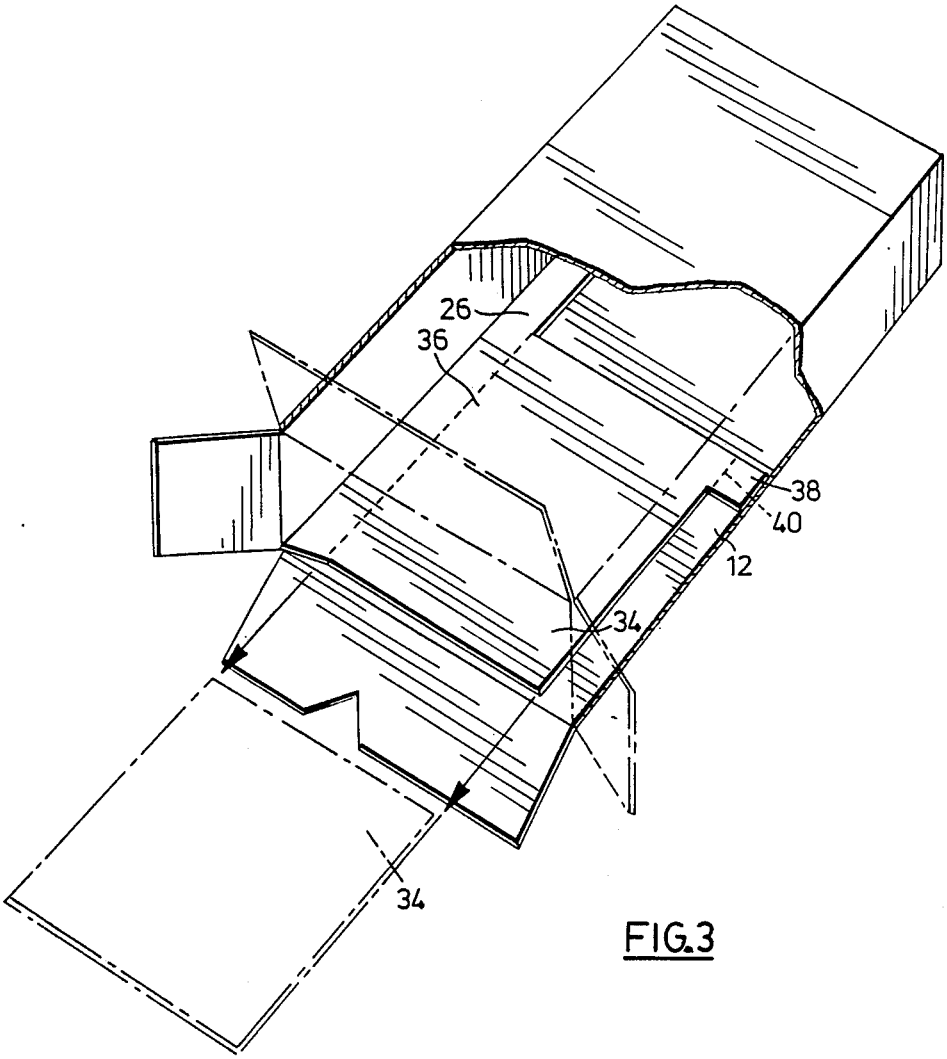

The invention will be more clearly understood after reference to the following detailed specification read in conjunction with the drawings wherein;

FIG. 1 is a plan view of a blank suitable for use in manufacturing a carton assembly constructed in accordance with an embodiment of the present invention, FIG. 2 is a plan view of the carton of FIG. 1 showing the carton folded and glued to provide a tubular sleeve configuration, FIG. 3 is a pictorial end view showing the position which the card will assume when the carton is in its erected configuration and also showing in broken lines, the card after it has been detached.

With reference to FIG. 1 of the drawings, the reference numeral 10 refers generally to a carton blank constructed in accordance with an embodiment of the present invention. The carton blank 10 comprises side wall panels, 12, 14, 16 and 18 which are hingedly connected to one another along longitudinal fold lines 20, 22 and 24. A glue flap 26 is hingedly connected to the side panel 18 along a fold line 28. End closure flaps 12*a*, 12*b*, 14*a*, 14*b*, 16*a*, 16*b*, 18*a* and 18*b* are connected to the side wall panels 12, 14, 16 and 18 respectively along weakened fold lines 30 and 32. A premium card 34 is formed integrally with the glue flap 26 and is connected thereto along a weakened tear line 36. A glue tab 38 is connected to the premium card 34 along a weakened tear line 40.

The blank 10 has an inner face 42 which is the face which is exposed in FIG. 1 of the drawings. The blank 10 also has an outer face 44 which is the face which is hidden from view in FIG. 1. Glue is initially applied to the front face 44 of the glue flap 26 along a narrower band 46 and is also applied to the front face of the glue tab 38 along a narrow band 48.

In order to assemble the carton, the carton blank is initially folded along the fold line 28 to fold the glue flap 26, the premium card 34 and the glue tab 38 inwardly into a face-to-face relationship with respect to the panels 18 and 16. Thereafter, the blank is folded along the fold line 22 to locate the panels 12 and 14 in a position overlying the panels 16 and 18 with a marginal edge portion of the panel 12 overlying the glue band 46 of the glue flap 26 to be secured thereto. In this position, the glue tab 38 will be located in a face-to-face relationship with respect to the inner face of the panel 12 and will be adhesively secured thereto by means of the adhesive strip 48.

The partially assembled carton can then be opened from its knocked-down configuration to its tubular sleeve configuration in a conventional manner. In so doing, the premium card 34 will remain in an intimate face-to-face relationship with respect to the panel 12 as shown in FIG. 3.

In order to remove the premium card 34, it is merely necessary to sever the card from the glue flap 26 and tab 38 by tearing along the weakened tear lines 36 and 40 respectively. This can be achieved by prying the upper end of the card away from the front panel 12 and inserting a table knife or a finger between the card 34 and the wall 12.

From the foregoing, it will be seen that the premium card 34 is located in an intimate face-to-face relationship with respect to the wall 12 during the assembly of the carton and it will remain in this position when the carton is erected for loading and will not therefore present an obstacle to the loading of the carton with the product which is to be shipped therein.

It will also be noted that the art which is to be applied to the premium card can be printed on the outer face of the card which is formed by the outer face 44 of the blank and may therefore be applied during the same printing operation as that used to print the artwork on the outer face of the carton blank. Thus it is not necessary to carry out two distinctly separate printing operations in order to print the artwork on the premium cards. In some instances, however, it may be desirable to print both faces of the card, however, in most instances, the artwork which will appear on one face of the card is more complex than that which will appear on the other face of the card and generally the face of the card which will bear the most complex artwork is that which forms the outer face of the blank which is the face which usually has a higher quality finish.

From the foregoing, it will be apparent that the carton construction of the present invention incorporates a premium card which does not require a separate stuffing operation in order to locate it within the shipping carton in use.

Various modifications of the present invention will be apparent to those skilled in the art. For example, it will be apparent that the card 34 may be used to provide a sales premium such as a discount coupon or the like.

I claim:

1. In a carton of the type having a plurality of side wall panels hingedly connected to one another and a narrow glue flap connected to a first of said side wall panels along a hinge line and adhesively connected in a face-to-face relationship with respect to a marginal edge portion of an inner face of a second of said side wall panels to form a tubular sleeve in which there is only panel thickness at each hinge, the improvement of;

a premium card formed integrally with said glue flap and connected thereto along a first weakened tear line, said card having a glue tab connected thereto at a point remote from the first weakened tear line along a second weakened tear line, the width of the glue flap and the premium card, including the glue tab being no greater than the width of the inner face of said second panel, said glue tab being adhesively secured to the inner face of said second panel to retain the card in the carton in an intimate face-to-face relationship with said second panel in a position in which the glue flap and premium card, including the glue tab do not bridge the hinge connections between the side wall panels of the carton and do not inhibit the opening of the carton from a knock-down configuration to an open sleeve configuration, said card being detachable by tearing along the first and second weakened tear lines to be removable from the carton, said premium card has a pair of oppositely disposed side edges, one of which is connected to said glue flap along said first weakened tear line and the other of which is connected to said glue tab along said second weakened line which is substantially shorter than the first weakened tear line so as to facilitate the release of the premium card.

2. In a carton of the type having a plurality of side wall panels hingedly connected to one another and a narrow glue flap connected to a first of said side wall panels along a hinge line and adhesively connected in a face-to-face relationship with respect to a marginal edge portion of an inner face of a second of said side wall panels to form a tubular sleeve in which there is only panel thickness at each hinge, the improvement of;

a premium card formed integrally with said glue flap and connected thereto along a first weakened tear line, said card having a glue tab connected thereto at a point remote from the first weakened tear line along a second weakened tear line, the width of the glue flap and the premium card, including the glue tab being no greater than the width of the inner face of said second panel, said glue tab being adhesively secured to the inner face of said second panel to retain the card in the carton in an intimate face-to-face relationship with said second panel, in a position in which the glue flap and premium card, including the glue tab do not bridge the hinge connections between the side wall panels of the carton and do not inhibit the opening of the carton from a knock-down configuration to an open sleeve configuration, said card being detachable by tearing along the first and second weakened tear lines to be removable from the carton, each side wall has an upper end and a lower end, said hinge connections extending longitudinally between the upper and lower ends, said premium card having an upper edge and a lower edge, said upper edge being located below the upper end of the side walls in close proximity thereto, said premium card having an outer edge which is remote from said glue flap, said outer edge having an upper end and a lower end, said glue tab being connected to the outer edge of the premium card at a point remote from the upper end thereof such that a major portion of the outer edge of the premium card which extends toward the upper end of the side walls is free of attachment to the underlying side wall to be manually accessible for movement away from the underlying side wall to facilitate tearing along said tear lines during the removal of the premium card without damaging the integrity of the carton.

3. A carton comprising a unitary blank which comprises a plurality of side wall panels hingedly connected to one another and a narrow glue flap connected to a first of said side wall panels along a hinge line and adhesively connected in a face-to-face relationship with respect to a marginal edge portion of an inner face of a second of said side wall panels to form a tubular sleeve in which there is only panel thickness at each hinge, said first side wall panel having an upper edge and a lower edge, a premium card formed integrally with said glue flap, said card having an upper edge and being connected to the glue flap along a first weakened tear line which extends away from the upper edge of the card, said card having a glue tab connected thereto, at a point remote from the first weakened tear line, along a second weakened tear line, the width of the glue flap and the premium card, including the glue tab being no greater than the width of the inner face of said second panel, said glue tab being adhesively secured to the inner face of said second panel to retain the card in the carton in an intimate face-to-face relationship with said second panel in a position in which the glue flap and premium card, including the glue tab do not bridge the hinge connections between the side wall panels of the carton and do not inhibit the opening of the carton from a knock-down configuration to an open sleeve configuration, said premium card having an upper edge extending adjacent to and below the upper edge of the first side wall and being free of attachment to the first side wall such that said upper edge of the card may be deflected away from the front panel to provide finger access to the upper edge of the card to permit the card to be removed by tearing along the first and second weakened tear lines to be removable from the carton.

* * * * *